US010322446B2

(12) United States Patent
Tabata et al.

(10) Patent No.: US 10,322,446 B2
(45) Date of Patent: Jun. 18, 2019

(54) NITRIDED LAYER REPAIR METHOD

(71) Applicants: TOYOTA JIDOSHA KABUSHIKI KAISHA, Toyota-shi, Aichi-ken (JP); Toyota School Foundation, Nagoya-shi, Aichi-ken (JP); TETRA Co., Ltd., Kasugai-shi, Aichi-ken (JP)

(72) Inventors: Eiji Tabata, Nisshin (JP); Yuichi Furukawa, Toyota (JP); Yoshiki Tsunekawa, Nagoya (JP); Hiroyuki Matsubara, Owariasahi (JP)

(73) Assignees: TOYOTA JIDOSHA KABUSHIKI KAISHA, Toyota-shi, Aichi-ken (JP); TETRA CO., LTD, Kasugai-shi, Aichi-ken (JP); TOYOTA SCHOOL FOUNDATION, Nagoya-shi, Aichi-ken (JP)

( * ) Notice: Subject to any disclaimer, the term of this patent is extended or adjusted under 35 U.S.C. 154(b) by 75 days.

(21) Appl. No.: 15/702,439

(22) Filed: Sep. 12, 2017

(65) Prior Publication Data

US 2018/0085823 A1 Mar. 29, 2018

(30) Foreign Application Priority Data

Sep. 29, 2016 (JP) ..... 2016-191441

(51) Int. Cl.

| | |
|---|---|
| ***C23C 8/26*** | (2006.01) |
| ***B22D 17/22*** | (2006.01) |
| ***B22D 17/20*** | (2006.01) |
| ***C23C 8/50*** | (2006.01) |

(52) U.S. Cl.

CPC ..... *B22D 17/2209* (2013.01); *B22D 17/2007* (2013.01); *C23C 8/26* (2013.01); *C23C 8/50* (2013.01)

(58) Field of Classification Search

CPC ..... C23C 8/26; C23C 8/50; B22D 17/2209; B22D 17/2007

See application file for complete search history.

(56) References Cited

U.S. PATENT DOCUMENTS

| | | | |
|---|---|---|---|
| 2009/0050288 | A1 | 2/2009 | Laudenklos |
| 2011/0104368 | A1 | 5/2011 | Furukawa |
| 2015/0218385 | A1 | 8/2015 | Furukawa et al. |

FOREIGN PATENT DOCUMENTS

| | | | |
|---|---|---|---|
| CN | 102049469 | A | 5/2011 |
| JP | 2002-060845 | A | 2/2002 |
| JP | 2009-528921 | A | 8/2009 |
| JP | 2013-244534 | A | 12/2013 |
| JP | 2016033251 | A | 3/2016 |

*Primary Examiner* — Jessee R Roe

(74) *Attorney, Agent, or Firm* — Sughrue Mion, PLLC

(57) ABSTRACT

There is provided a nitrided layer repair method in which a molten metal is pressurized and solidified, and thus a nitrided layer formed on a cavity surface of a mold used to form a casting object is repaired. In the nitrided layer repair method, a nitriding source is applied to the cavity surface, and the cavity surface of the mold is nitrided by heating and pressurizing the cavity surface using the molten metal.

5 Claims, 7 Drawing Sheets

NITRIDED LAYER REPAIR METHOD

INCORPORATION BY REFERENCE

The disclosure of Japanese Patent Application No. 2016-191441 filed on Sep. 29, 2016 including the specification, drawings and abstract is incorporated herein by reference in its entirety.

BACKGROUND

1. Technical Field

The present disclosure relates to a nitrided layer repair method, for example, a method of repairing a nitrided layer formed on a surface of a casting mold.

2. Description of Related Art

In order to increase durability, a nitrided layer is formed on a surface of a casting mold. However, when a mold is repeatedly used for casting, a nitride concentration on the surface decreases, and heat checking (heat cracking) occurs. For this reason, a re-nitriding treatment is performed on the surface of a mold in an offline mode.

A method of repairing a nitrided layer according to a nitriding treatment using ammonia gas is disclosed in Japanese Patent Application Publication No. 2016-033251 (JP 2016-033251 A). In the method in JP 2016-033251 A, a projection agent containing a plurality of oxides is adhered to a surface of the mold, and a nitriding treatment using a lower concentration of ammonia gas than used when a nitrided layer of a base is formed is then performed.

SUMMARY

For example, when a re-nitriding treatment such as a nitriding treatment using ammonia gas is performed, it is necessary to remove a mold from a die casting machine and perform the treatment in an offline mode. Therefore, a casting process has to be interrupted and productivity decreases.

The present disclosure provides a nitrided layer repair method through which it is possible to suppress a decrease in productivity.

In a nitrided layer repair method according to an aspect of the present disclosure, a molten metal is pressurized and solidified, and thus a nitrided layer formed on a cavity surface of a mold used to form a casting object is repaired. The nitrided layer repair method includes applying a nitriding source to the cavity surface; and nitriding the cavity surface of the mold by heating and pressurizing the cavity surface using the molten metal. In such a configuration, it is possible to prevent a decrease in productivity.

In the above aspect, the nitriding source may include urea.

In the above aspect, the nitriding source may be applied to the cavity surface together with a release agent.

In the above aspect, when a shot that includes applying the release agent to the cavity surface, clamping the mold to form a cavity surrounded by the cavity surface, injecting and filling the molten metal into the cavity, pressurizing and solidifying the molten metal filled into the cavity, and opening the mold that is clamped and removing the casting object that is pressurized and solidified is performed a plurality of times while the mold is connected to a die casting machine, the nitriding source may be applied to the cavity surface together with the release agent at least once.

In the above aspect, when preheating of the mold starts before the shot is performed, the nitriding source may be applied to the cavity surface.

According to the present disclosure, it is possible to provide a nitrided layer repair method through which it is possible to suppress a decrease in productivity.

BRIEF DESCRIPTION OF THE DRAWINGS

Features, advantages, and technical and industrial significance of exemplary embodiments will be described below with reference to the accompanying drawings, in which like numerals denote like elements, and wherein.

DETAILED DESCRIPTION OF EMBODIMENTS

Embodiments of the present disclosure will be described below with reference to the accompanying drawings. However, the present disclosure is not limited to the following embodiments. In addition, the following description and drawings will be appropriately simplified for clarity of explanation.

Figure 1A:
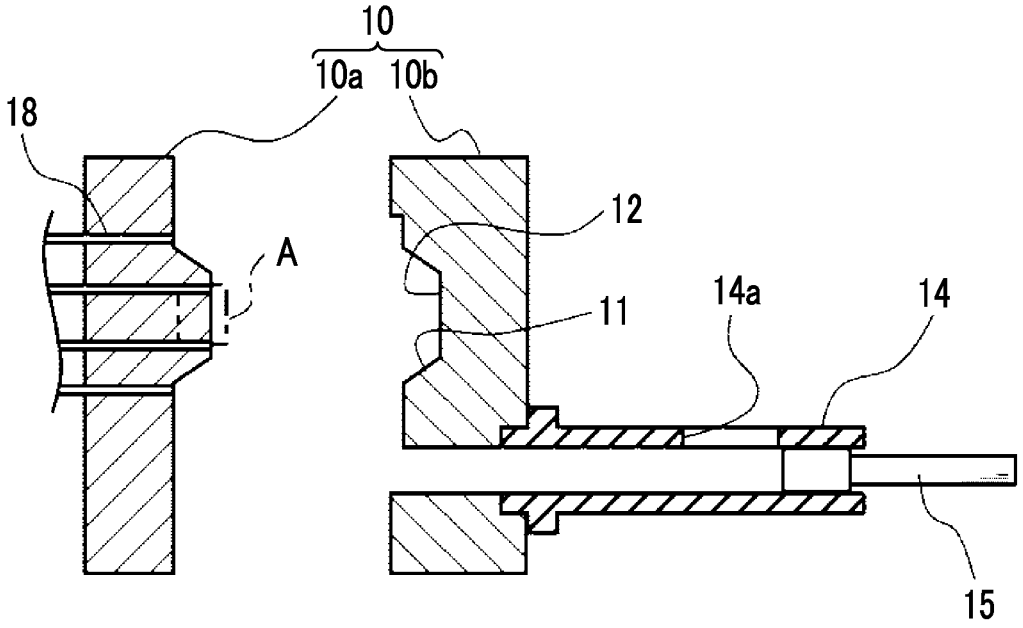
FIG. 1A is a cross-sectional view of an example of a mold to which a nitrogen source is applied in a nitrided layer repair method according to an embodiment.
Figure 1B:
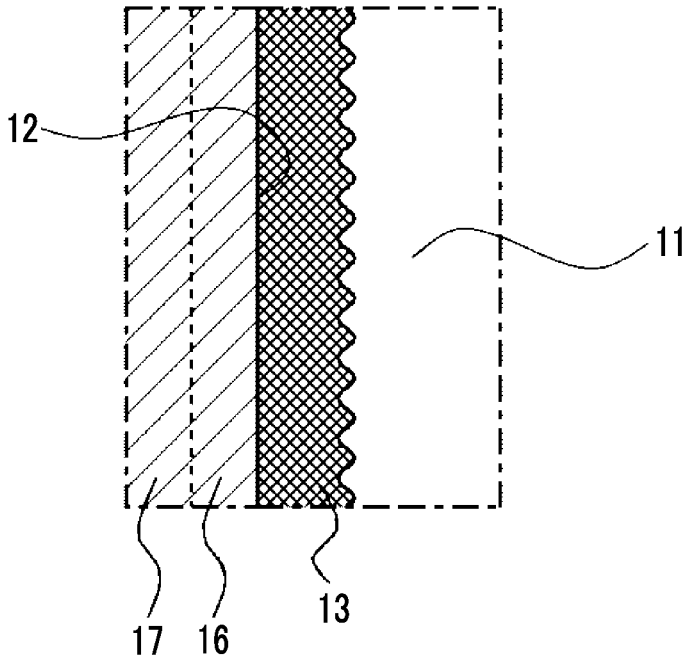
FIG. 1B is an enlarged cross-sectional view of a part A in FIG. 1A.

A nitrided layer repair method according to an embodiment will be described. The present embodiment is, for example, a method of repairing a nitrided layer formed on a cavity surface of a mold used for casting. First, a configuration of the mold used in the nitrided layer repair method will be described. FIG. 1A is a cross-sectional view of an example of a mold to which a nitrogen source is applied in the nitrided layer repair method according to the embodiment. FIG. 1B is an enlarged cross-sectional view of a part A in FIG. 1A.

As shown in FIGS. 1A and 1B, a mold 10 pressurizes and solidifies a molten metal to form a casting object. The mold 10 is, for example, a mold 10 used in a die casting method. The mold 10 used in the die casting method includes, for example, a plurality of components, in order to remove the casting object that is casted. The mold 10 includes, for example, a movable mold 10*a* and a fixed mold 10*b*. The mold 10 is made of a predetermined steel material. For example, the mold 10 may include an alloy tool steel for a hot mold (an SKD61 substrate). The SKD61 substrate is a kind of alloy tool steel in which tungsten, molybdenum, chromium, vanadium, or the like are added to a carbon tool steel. Here, the mold 10 is not limited to a mold including the movable mold 10*a* and the fixed mold 10*b*. In addition, the material of the mold 10 is not limited to the SKD61 substrate.

The mold 10 includes a cavity 11. The cavity 11 is a hollow part that is formed inside the mold 10 and is a part filled with a molten metal 20. For example, when the movable mold 10*a* and the fixed mold 10*b* are clamped, the cavity 11 is formed inside the mold 10. A surface of the mold 10 in contact with the cavity 11 is referred to as a cavity surface 12. The cavity 11 is surrounded by the cavity surface 12 of the mold 10. Then, the molten metal 20 is filled into the cavity 11 surrounded by the cavity surface 12 of the mold 10.

A nitriding source 13 is applied to the cavity surface 12 of the mold 10. For example, the nitriding source 13 is applied in a layer form on the cavity surface 12 of the mold 10. The nitriding source 13 includes, for example, urea. For example, the nitriding source 13 is a release agent including urea. When the nitriding source 13 is included in the release agent, the nitriding source 13 is applied to the cavity surface 12 of the mold 10. For example, the release agent including urea is sprayed onto the cavity surface 12 of the mold 10. The nitriding source 13 may be a solution including urea. The nitriding source 13 may be applied by spraying the solution including urea to the cavity surface 12 of the mold 10.

The nitriding source 13 may be applied to the cavity surface 12 of the mold 10 periodically in a casting process. For example, the nitriding source 13 may be applied to the cavity surface 12 of the mold 10 as a startup agent including the nitriding source 13 when startup is performed about once a week. In addition, the nitriding source 13 may be applied for each shot in which a molten metal is injected and filled into the mold 10 to form a casting object.

When the nitriding source 13 is applied to the cavity surface 12 of the mold 10, a nitrided layer 16 may be formed on the cavity surface 12 of the mold 10. That is, the nitriding source 13 may be applied to the cavity surface 12 in which the nitrided layer 16 is formed in advance before the mold 10 is used for casting. In addition, the nitriding source 13 may be applied to the cavity surface 12 including the nitrided layer 16 that has undergone denitriding according to the use for casting. Furthermore, the nitriding source 13 may be applied to the cavity surface 12 in which the nitrided layer 16 formed by casting in advance has disappeared.

The nitrided layer 16 is formed on the cavity surface 12 of the mold 10 in order to suppress, for example, heat checking. When the nitrided layer 16 is formed, it is possible to increase the hardness of the cavity surface 12 of the mold 10. The nitrided layer 16 may include, for example, a nitrogen composite layer or may include a layer into which nitrogen is diffused. The nitrided layer 16 is, for example, a part with a higher nitrogen concentration than an unnitrided part 17 of the mold 10 and is, for example, a part including nitrogen at 0.5 weight % or more. For example, the nitrided layer 16 may be formed from the surface on the cavity surface 12 of the mold 10 to a depth of 50 to 90 μm. The unnitrided part 17 is a part other than the nitrided layer 16.

A sleeve 14 is connected to the mold 10. The sleeve 14 has a cylindrical shape. The sleeve 14 has one end that is connected to an opening which communicates with the cavity 11 of the mold 10. The sleeve 14 has the other end into which a chip 15 is inserted. A supply port 14*a* made of a molten metal is provided in a part of the sleeve 14. A pin 18 is provided to remove a casting object.

Figure 2A:
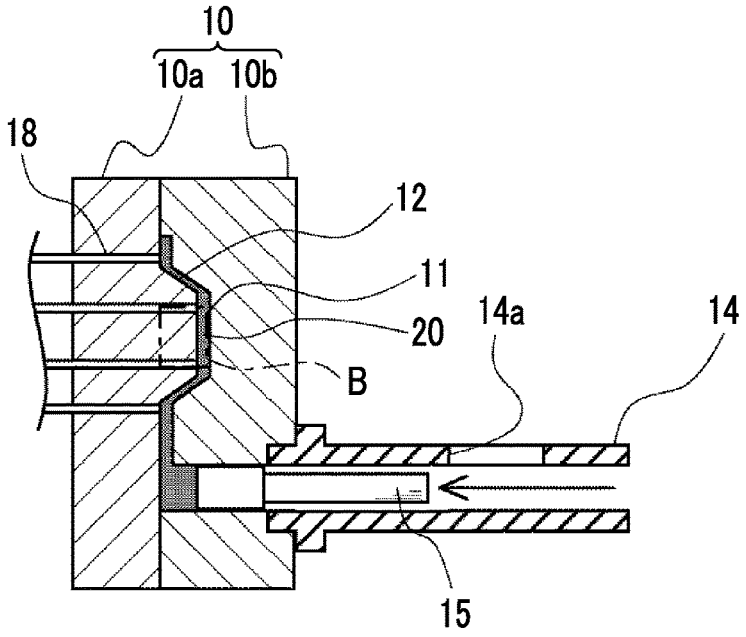
FIG. 2A is a cross-sectional view of an example of a mold filled with a molten metal in the nitrided layer repair method according to the embodiment.
Figure 2B:
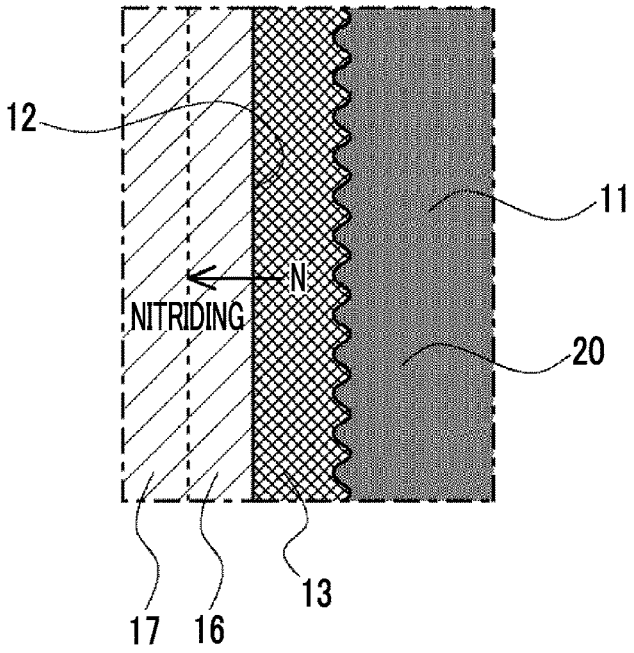
FIG. 2B is an enlarged cross-sectional view of a part B in FIG. 2A.

FIG. 2A is a diagram showing an example of a mold filled with a molten metal in the nitrided layer repair method according to the embodiment. FIG. 2B is an enlarged cross-sectional view of a part B in FIG. 2A.

As shown in FIGS. 2A and 2B, the molten metal 20 is supplied into the cylindrical sleeve 14 from the supply port 14*a*, and is pushed into the cavity 11 by the chip 15. The molten metal 20 passes through the sleeve 14 and is sent to the cavity 11.

The temperature of the molten metal 20 depends on a kind of a metal of the molten metal 20, and, is, for example, 650° C. Here, the temperature of the molten metal 20 is not limited thereto. In the process of injecting and filling, pressurizing and solidifying, and removing the molten metal 20, the temperature of the mold 10 that has received heat from the molten metal 20 is, for example, 500° C. A time required for the process of injecting and filling, pressurizing and solidifying, and removing the molten metal 20 depends on the size of a product, and is, for example, 10 to 20 seconds. The casting pressure of the molten metal 20 injected into the cavity 11 is, for example, 50 MPa. The casting pressure of the molten metal 20 is not limited thereto.

On the cavity surface 12 of the mold 10 into which the molten metal 20 is filled, due to heat from the molten metal 20 and pressurization, nitrogen molecules of the nitriding source 13 move into the inside of the mold 10 from the cavity surface 12 of the mold 10.

When the nitrided layer 16 is formed in advance before the mold 10 is used for casting, and when the nitrided layer 16 has become denitrided according to the use for casting, the nitrided layer 16 is formed just below the nitrided layer 16, and the thickness of the nitrided layer 16 increases due to the application of the nitriding source 13 and heat received from the molten metal and pressurization.

On the other hand, when the nitrided layer 16 on the cavity surface 12 has disappeared, the nitrided layer 16 is formed on the cavity surface 12. In this manner, the nitrided layer 16 is formed on a part on the side of the cavity surface 12 of the unnitrided part 17 of the mold 10, for example, just below the nitrided layer 16 or on the cavity surface 12.

As described above, in the present embodiment, the nitriding source 13 is applied to the cavity surface 12, and the cavity surface 12 of the mold 10 is nitrided when the molten metal 20 is heated and pressurized. Accordingly, the nitrided layer 16 on the cavity surface 12 of the mold 10 is repaired.

Figure 3:
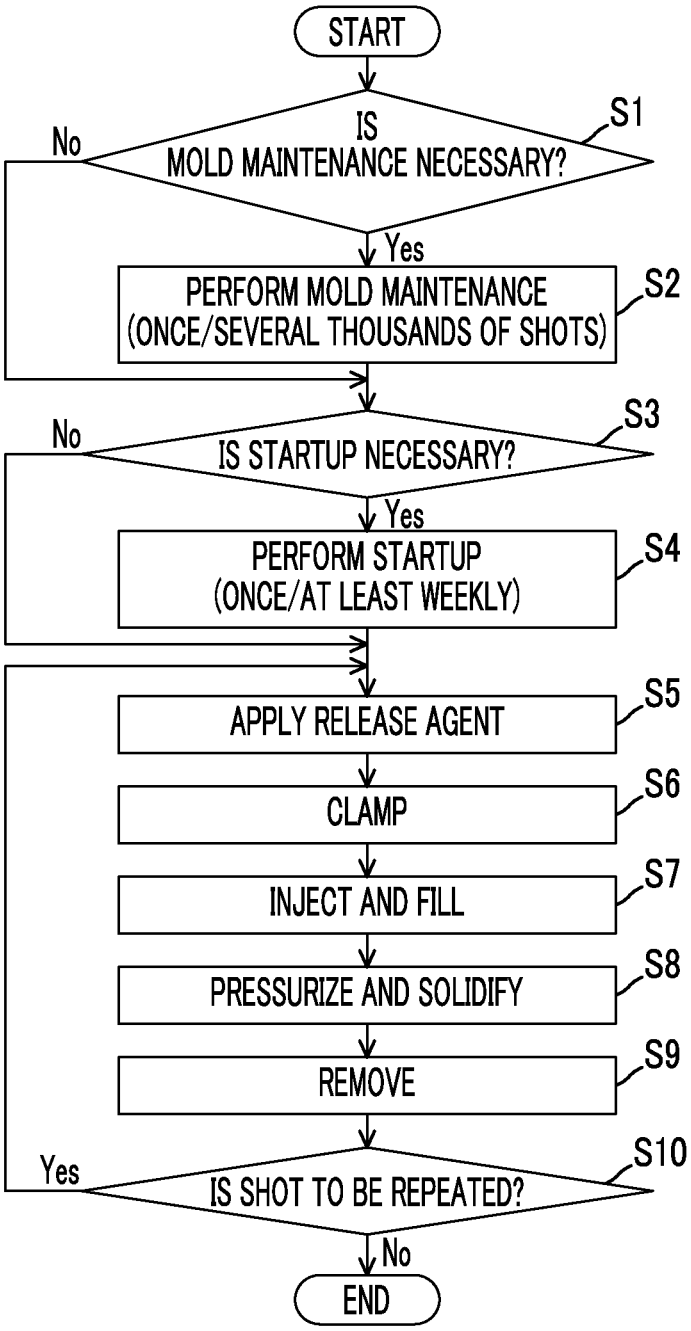
FIG. 3 is a flowchart showing an exemplary casting process in which the nitrided layer repair method according to the embodiment is used.

Next, the flow of the nitrided layer repair method according to the present embodiment will be described. FIG. 3 is a flowchart showing an exemplary casting process including the nitrided layer repair method according to the embodiment.

As shown in Step S1 in FIG. 3, first, it is determined whether mold maintenance is necessary. Mold maintenance is performed, for example, about once every several thousands of shots. Specifically, disassembly, cleaning, adjustment, and the like are performed on the mold 10. When it is determined that mold maintenance is necessary (Yes), as shown in Step S2, the mold maintenance is performed.

When it is determined that mold maintenance is not necessary (No), the process advances to Step S3.

Next, as shown in Step S3 in FIG. 3, it is determined whether startup is necessary. Startup is performed about once a week. In addition, startup is performed about once every plurality of shots. In this manner, startup is periodically performed. Specifically, startup includes preheating the mold 10, preparing a raw material of the molten metal 20, and the like. In addition, a startup agent may be applied to the cavity surface 12 of the mold 10. Further, urea may be included in the startup agent. The nitriding source 13 may be applied to the cavity surface 12 of the mold 10 by applying the startup agent including urea. In this manner, the nitriding source 13 may be periodically applied to the cavity surface 12 of the mold 10.

When startup is necessary (Yes), as shown in Step S4, startup is performed. When startup is not necessary (No), the process advances to Step S5. Here, the processes of Step S5 to Step S9 are referred to as a shot. The shot indicates forming a casting object by injecting and filling the molten metal 20 into the mold 10, and specifically includes a release agent applying process, a clamping process, an injecting and filling process, a pressurizing and solidifying process, and a removing process.

Next, as shown in Step S5 in FIG. 3, the release agent is applied to the cavity surface 12 of the mold 10. The release agent may include the nitriding source 13. The release agent may include, for example, urea, as the nitriding source 13. The application of the release agent is performed such that, for example, the release agent is sprayed to the cavity surface 12 of the mold 10. Instead of or together with the release agent, a urea aqueous solution may be applied to the surface of the mold 10.

Next, as shown in Step S6 in FIG. 3, the mold 10 is clamped. The clamping of the mold 10 is performed such that the movable mold 10*a* and the fixed mold 10*b* of the mold 10 are combined to form the cavity 11 surrounded by the cavity surface 12 of the mold 10.

Next, as shown in Step S7 in FIG. 3, the molten metal 20 is injected and filled into the cavity 11 of the mold 10. The molten metal 20 is supplied into the cylindrical sleeve 14 from the supply port 14*a*, and is then pushed into the cavity 11 by the chip 15. In this manner, the molten metal 20 passes through the sleeve 14 and is injected and filled into the cavity 11.

Next, as shown in Step S8 in FIG. 3, the molten metal 20 filled into the cavity 11 is pressurized and solidified. The pressure is, for example, 50 MPa. In this case, nitrogen molecules of the nitriding source 13 move into the mold 10 from the cavity surface 12 of the mold 10. Then, the nitrogen molecules having moved into the mold 10 repair the nitrided layer on the cavity surface 12 of the mold 10. In this manner, in the present embodiment, the nitrided layer 16 on the cavity surface 12 of the mold 10 is repaired using the heated and pressurized molten metal 20.

Next, as shown in Step S9 in FIG. 3, the clamped mold 10 is opened and the pressurized and solidified casting object is removed. For example, the movable mold 10*a* of the mold 10 is moved and the casting object is separated from the fixed mold 10*b*. Then, the casting object is pushed up by the pin 18 and is removed from the cavity 11. In this manner, the casting object in which the molten metal 20 is pressurized and solidified is produced.

Next, as shown in Step S10 in FIG. 3, it is determined whether a shot is to be repeated. When it is determined that a shot is not to be repeated (No), the casting process ends. On the other hand, when it is determined that a shot is to be repeated (Yes), the process returns to Step S5, and the next shot is performed.

When such a shot is successively performed in an in-process manner, the shot is performed a plurality of times while the mold 10 is connected to a die casting machine. When the shot is performed a plurality of times, the nitriding source 13 is included in the release agent in the process of applying the release agent at least one shot. Accordingly, it is possible to repair the nitrided layer 16 in an in-process manner. Here, the nitriding source 13 is included in the release agent for each shot. Then, the nitriding source 13 may be applied. Accordingly, it is possible to prevent deterioration of the nitrided layer 16, for example, a decrease in the nitrogen concentration and denitriding.

Figure 4:
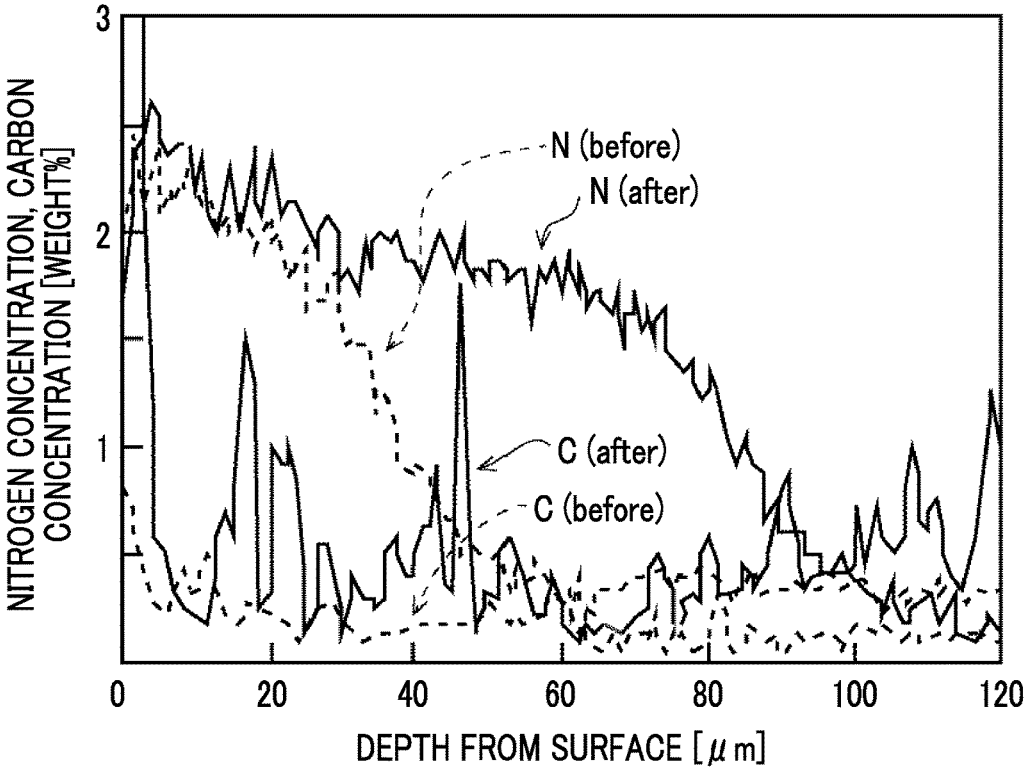
FIG. 4 is a graph showing examples of nitrogen and carbon concentration profiles in a cross section of the mold, the horizontal axis representing a depth from a surface and the vertical axis representing nitrogen and carbon concentrations.

FIG. 4 is a graph showing examples of nitrogen and carbon concentration profiles in a cross section of the mold, the horizontal axis representing the depth from the surface on the cavity surface and the vertical axis representing nitrogen and carbon concentrations. In the graph, "N" and "C" indicate a nitrogen concentration and a carbon concentration. In the graph, "(before)" and "(After)" indicate concentrations before and after urea is applied to the cavity surface 12 and heating is performed at 500° C. for 48 hours (hereinafter referred to as a "urea applying and heating treatment"). The pressure is 800 Pa.

As shown in FIG. 4, before and after the urea applying and heating treatment, carbon concentrations ("C(before)" and "C(After)") are 0.5 weight % or less in depths within the range shown in the graph and hardly change.

On the other hand, the nitrogen concentration ("N(before)") before the urea applying and heating treatment is 1.5 weight % or more within a depth of 30 μm from the surface, 1 weight % or less at a depth of 40 μm, and 0.5 weight % or less at a depth of 50 μm.

Meanwhile, the nitrogen concentration ("N(After)") after the urea applying and heating treatment is 1.5 weight % or more within a depth of 70 μm from the surface, 1 weight % or less at a depth of 80 μm, and 0.5 weight % or less at a depth of 90 μm. In this manner, the depth in which the nitrogen concentration is 0.5 weight % or more spreads from a depth of 50 μm to a depth of 90 μm due to the urea applying and heating treatment. That is, when the nitrided layer 16 is formed, the nitrided layer 16 becomes thicker than before urea is applied.

Figure 5:
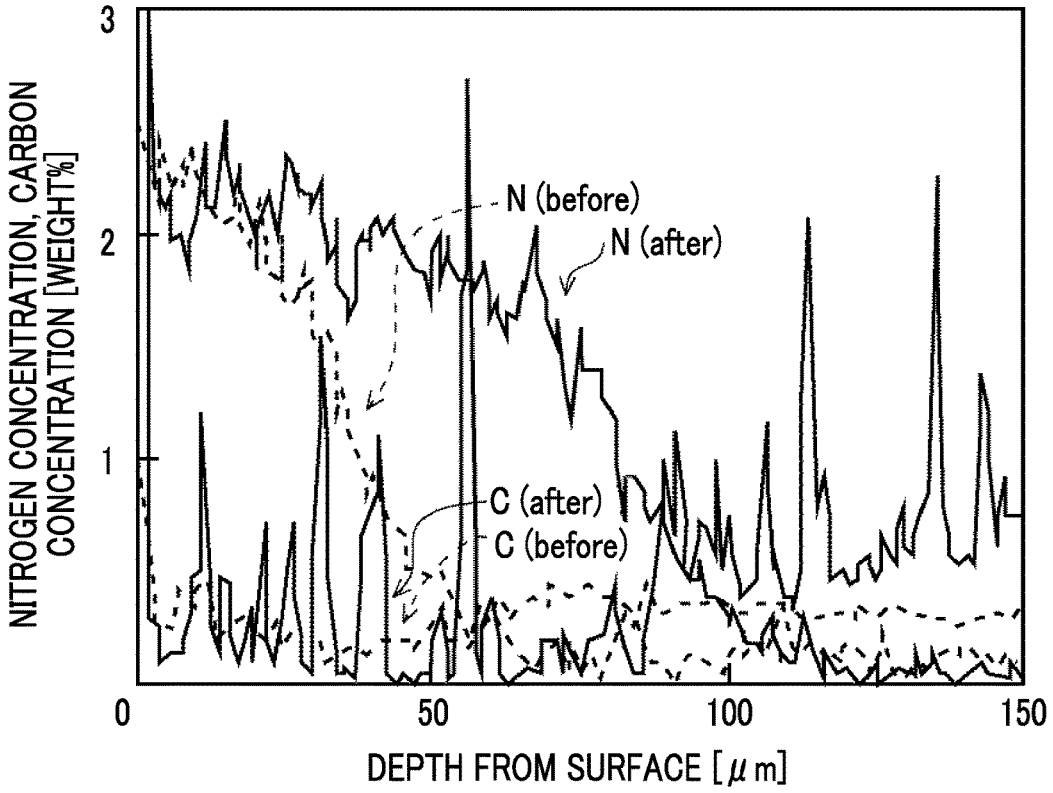
FIG. 5 is a graph showing examples of nitrogen and carbon concentration profiles in a cross section of the mold, the horizontal axis representing a depth from a surface and the vertical axis representing nitrogen and carbon concentrations.

FIG. 5 is a graph showing examples of nitrogen and carbon concentration profiles in a cross section of the mold, the horizontal axis representing a depth from the surface on the cavity surface, and the vertical axis representing nitrogen and carbon concentrations. In the graph, "N" and "C" indicate a nitrogen concentration and a carbon concentration. In the graph, "(before)" and "(After)" indicate concentrations before and after a urea-containing release agent is applied to the cavity surface 12 and heating is performed at 500° C. for 48 hours (hereinafter referred to as a "release agent applying and heating treatment"). FIG. 5 shows the results obtained when the urea-containing release agent is applied in place of application of urea as in FIG. 4.

As shown in FIG. 5, before and after the release agent applying and heating treatment, carbon concentrations ("C (before)," and "C(After)") are 0.5 weight % or less in depths with the range shown in the graph and hardly change.

On the other hand, the nitrogen concentration ("N(before)") before the release agent applying and heating treatment is 1.5 weight % or more within a depth of 30 μm from the surface, 1 weight % or less at a depth of 40 μm, and 0.5 weight % or less at depth of 50 μm.

Meanwhile, the nitrogen concentration ("N(After)") after the release agent applying and heating treatment is 1.5 weight % or more within a depth of 70 μm from the surface, 1 weight % or less at a depth of 80 μm, and 0.5 weight % or less at a depth of 90 μm. In this manner, the depth in which the nitrogen concentration is 0.5 weight % or more spreads from a depth of 50 μm to a depth of 90 μm due to the release agent applying and heating treatment. That is, when the nitrided layer 16 is formed, the nitrided layer 16 becomes thicker than before urea is applied.

Figure 6:
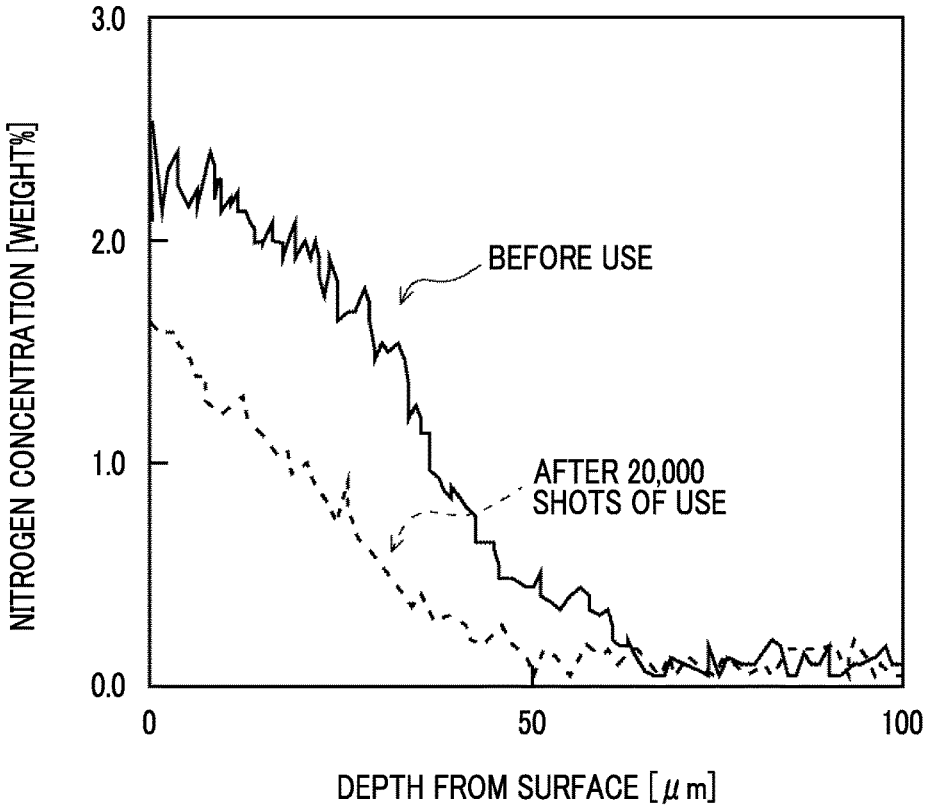
FIG. 6 is a graph showing examples of nitrogen concentration profiles in a cross section of the mold, the horizontal axis representing a depth from a surface and the vertical axis representing a nitrogen concentration.

FIG. 6 is a graph showing examples of nitrogen concentration profiles in a cross section of the mold. The horizontal axis representing a depth from the surface on the cavity surface and the vertical axis representing the nitrogen concentration. The expression "before use" and "after 20,000 shots of use" indicates a concentration before the mold is used for casting and a concentration after the mold is used for 20,000 shots of casting.

As shown in FIG. 6, the nitrogen concentration before the mold is used for casting (hereinafter referred to as "before use") is 1.5 weight % or more within a depth of 30 μm from the surface, 1 weight % or less at a depth of 40 μm, and 0.5 weight % or less at a depth of 50 μm.

On the other hand, the nitrogen concentration after the mold is used for 20,000 shots of casting (hereinafter referred to as "after use") is 1 weight % or less at a depth of 20 μm and 0.5 weight % or less at a depth of 30 μm.

Figure 7:
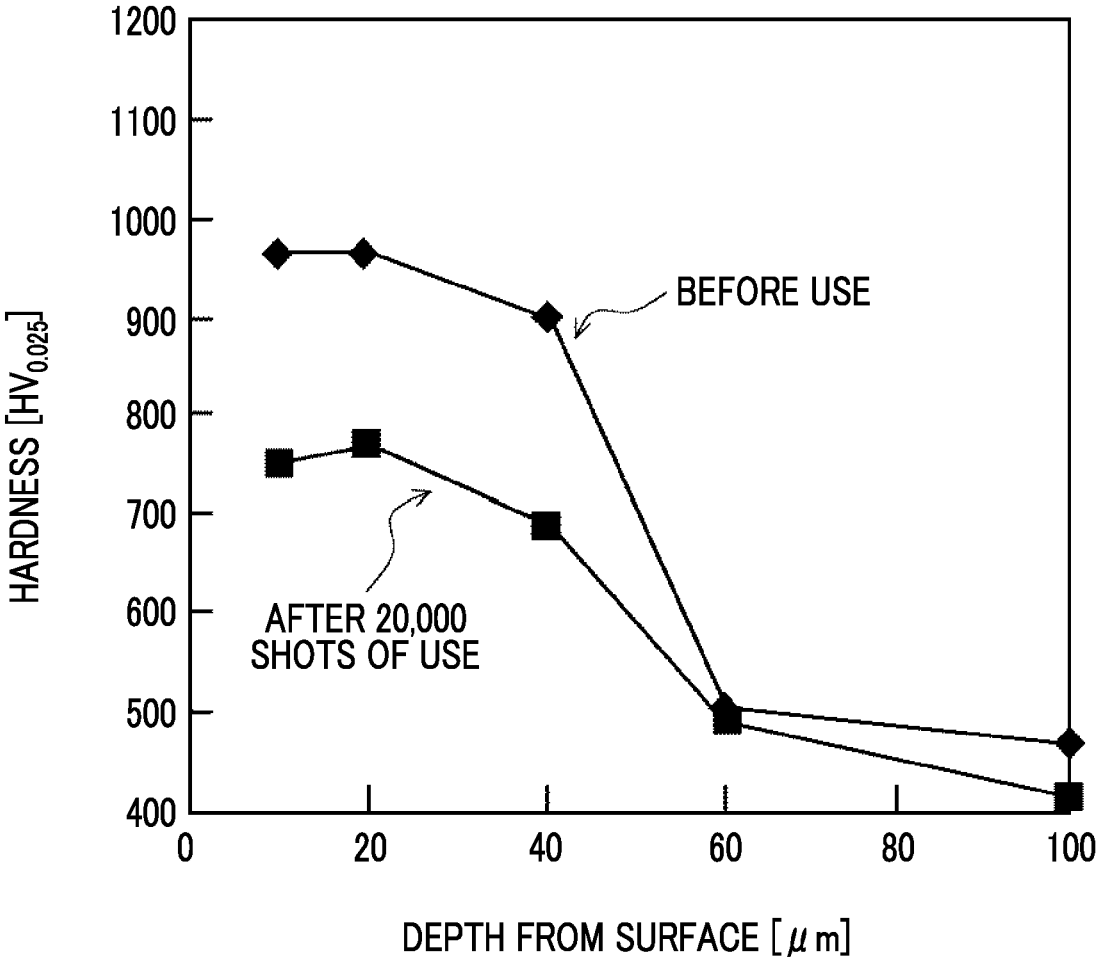
FIG. 7 is a graph showing an example of the hardness of a surface of the mold, the horizontal axis representing a depth from a surface and the vertical axis representing hardness.

FIG. 7 is a graph showing an example of the hardness of the cavity surface of the mold, the horizontal axis representing a depth from the surface on the cavity surface and the vertical axis representing the hardness. As shown in FIG. 7, the hardness before the mold is used for casting ("before use") is high at 900 HV or more within a thickness of 40 μm from the surface. Then, the hardness is 700 HV or less at a depth of 50 μm. On the other hand, the hardness after the mold is used for 20,000 shots of casting ("after 20,000 shots of use") is 700 HV or more within a thickness of 40 μm from the surface. When the depth is deeper than 40 μm, the hardness decreases to 700 HV or less.

As described above, the phenomenon in which the nitrogen concentration after use is lower than the nitrogen concentration before use and the nitrogen concentration decreases at a depth of 40 μm to 60 μm from the surface matches that in which the hardness after use is lower than the hardness before use and the hardness decreases at a depth of 40 μm to 60 μm from the surface. Therefore, the nitrogen concentration and the hardness have a correlation, and the hardness can be increased by increasing the nitrogen concentration.

In this manner, when the nitrided layer 16 is formed on the cavity surface 12 of the mold 10, the hardness of the cavity surface 12 can be increased and it is possible to prevent the occurrence of heat checking.

One of the problems of the mold 10 used for casting is surface cracking (heat cracking or heat checking). In order to prevent the occurrence of such surface cracking and increase durability, a nitriding treatment is generally performed on the cavity surface 12. However, when the mold 10 is successively used for casting, the nitrogen concentration in the cavity surface 12 decreases. Accordingly, heat checking is likely to occur. Therefore, a re-nitriding treatment is performed in order to increase the lifespan of the mold 10.

In the related art, the re-nitriding treatment needs to be performed in an offline mode in which the mold 10 is removed from a die casting machine. Therefore, the casting process had to be interrupted. As a result, productivity decreases.

On the other hand, according to the nitrided layer repair method of the present embodiment, it is possible to repair the nitrided layer 16 on the cavity surface 12 of the mold 10 in an in-process manner while the mold 10 is connected to a die casting machine. Accordingly, it is possible to repair the nitrided layer 16 while preventing a decrease in productivity.

In addition, in the nitrided layer repair method of the present embodiment, the heated and pressurized molten metal 20 is used. Therefore, it is possible to repair the nitrided layer 16 in an in-process manner. Urea is used in the nitriding source 13. Thus, urea that is included in a solution or a release agent can be applied to the cavity surface 12. The nitriding source 13 is included in the release agent. Then, the nitriding source 13 is applied to the cavity surface 12. In this manner, it is possible to repair the nitrided layer 16 in an in-process manner.

The nitriding source 13 may be included in a release agent for each shot. Then, the nitriding source 13 may be applied. Accordingly, it is possible to prevent deterioration of the nitrided layer 16, for example, a decrease in the nitrogen concentration, and denitrification.

While the embodiments according to the present disclosure have been described above, the present disclosure is not limited to the above configuration, and can be modified without departing from the scope of the present disclosure.

For example, the nitriding treatment method using the nitriding source 13 including urea described above is not limited to a nitrided layer repair method for the cavity surface 12 of the mold 10, and can be used as a nitriding treatment method for the surface of the mold 10 and a nitriding treatment method for an arbitrary member.

In addition, the scope of the present disclosure includes the following nitriding treatment methods:

A nitriding treatment method in which the molten metal 20 is pressurized and solidified and thus a surface of the mold 10 used to form a casting object is nitrided.

A nitriding treatment method in which the nitriding source 13 including urea is applied to the surface, the molten metal 20 is heated and pressurized, and then the surface of the mold 10 is nitrided.

A nitriding treatment method in which the molten metal 20 is pressurized and solidified and thus the surface of the mold 10 used to form a casting object is nitrided. A nitrided layer repair method in which the nitriding source 13 including urea is applied to the surface.

What is claimed is:

1. A nitrided layer repair method in which a molten metal is pressurized and solidified and thus a nitrided layer formed on a cavity surface of a mold used to form a casting object is repaired, comprising:

applying a nitriding source to the cavity surface; and nitriding the cavity surface of the mold by heating and pressurizing the cavity surface using the molten metal.

2. The nitrided layer repair method according to claim 1, wherein the nitriding source includes urea.

3. The nitrided layer repair method according to claim 1, wherein the nitriding source is applied to the cavity surface together with a release agent.

4. The nitrided layer repair method according to claim 3, wherein, when a shot that includes applying the release agent to the cavity surface, clamping the mold to form a cavity surrounded by the cavity surface, injecting and filling the molten metal into the cavity, pressurizing and solidifying the molten metal filled into the cavity, and opening the mold that is clamped and removing the casting object that is pressurized and solidified is performed a plurality of times while the mold is connected to a die casting machine, the nitriding source is applied to the cavity surface together with the release agent at least once.

5. The nitrided layer repair method according to claim 4, wherein, when preheating of the mold starts before the shot is performed, the nitriding source is applied to the cavity surface.

* * * * *